US008776569B2

(12) United States Patent
Lin

(10) Patent No.: US 8,776,569 B2
(45) Date of Patent: Jul. 15, 2014

(54) FORGING MOLD

(75) Inventor: Jui-Pin Lin, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 697 days.

(21) Appl. No.: 13/070,458

(22) Filed: Mar. 23, 2011

(65) Prior Publication Data

US 2012/0240653 A1 Sep. 27, 2012

(51) Int. Cl.
*B21D 45/00* (2006.01)

(52) U.S. Cl.
USPC ..... 72/344; 72/352; 72/481.3; 72/481.8

(58) Field of Classification Search
USPC ..... 72/344, 352, 353.2, 353.6, 354.2, 72/354.6, 358, 359, 481.3, 481.4, 481.5, 72/481.6, 481.7, 481.8
See application file for complete search history.

(56) References Cited

U.S. PATENT DOCUMENTS

| | | | | |
|---|---|---|---|---|
| 1,480,142 | A * | 1/1924 | Bell | 72/344 |
| 3,381,515 | A * | 5/1968 | Orloff | 72/400 |
| 5,860,315 | A * | 1/1999 | Sawdon | 72/481.8 |
| 6,189,361 | B1 * | 2/2001 | Seki et al. | 72/325 |
| 6,477,883 | B2 * | 11/2002 | Liu | 72/357 |
| 8,302,447 | B2 * | 11/2012 | Schmitz et al. | 72/354.2 |

* cited by examiner

*Primary Examiner* — Edward Tolan
(74) *Attorney, Agent, or Firm* — Cheng-Ju Chiang

(57) ABSTRACT

A forging mold includes a female mold and a male mold coupling with the female mold. The female mold includes an external mold defining an accommodating groove for receiving an internal mold and a pressing block therein, and a first fixing hole penetrating through the external mold and connected with the accommodating groove. The pressing block has a gap opened at a bottom portion thereof and adjacent to the internal mold. The internal mold has a base body and a blocking protrusion protruded from a bottom portion of the base body to be pressed in the gap. A first fixing element is screwed into the first fixing hole of the external mold with a distal end thereof resisting against the pressing block to further press the pressing block towards the internal mold so as to secure the internal mold and the pressing block in the accommodating groove.

8 Claims, 4 Drawing Sheets

FORGING MOLD

BACKGROUND OF THE INVENTION

1. Field of the Invention

The present invention relates to a mold, and particularly to a forging mold having an internal mold mounted therein.

2. The Related Art

Referring to FIG. 1 and FIG. 2, a conventional forging mold used to forge a probe terminal (not shown) includes a female mold 100' and a male mold (not shown) coupling with the female mold 100' to define a shaping cavity (not shown) therebetween for forging the probe terminal. The female mold 100' has an external mold 10', an internal mold 20', and an ejector pin 30'. The external mold 10' defines an accommodating groove 11' penetrating through a top surface thereof for accommodating the internal mold 20' therein, and a passing hole 12' penetrating through a bottom surface thereof and further connected with the accommodating groove 11'. The internal mold 20' is wedged in the accommodating groove 11' of the external mold 10' by a pressing machine (not shown). The internal mold 20' defines an ejecting hole 22' vertically penetrating therethrough to connect with the shaping cavity and the passing hole 12'. The ejector pin 30' is movably inserted in the passing hole 12' and the ejecting hole 22' to eject the probe terminal out of the female mold 100'.

In the process of forging the probe terminal, as forging materials continuously attack the internal mold 20', the internal mold 20' is apt to be damaged. However, since the internal mold 20' is wedged in the accommodating groove 11' of the external mold 10' by the pressing machine, it is difficult to demount the internal mold 20' from the external mold 10' when the internal mold 20' is damaged. As a result, the cost of manufacturing the forging mold is greatly increased as both the internal mold 20' and the external mold 10' are usually replaced together.

SUMMARY OF THE INVENTION

Accordingly, an object of the present invention is to provide a forging mold which includes a female mold and a male mold coupling with the female mold to define a shaping cavity therebetween. The female mold includes an external mold which defines an accommodating groove penetrating through a top surface thereof. A periphery outside of the external mold defines a first fixing hole extending towards the accommodating groove to be connected with the accommodating groove. An internal mold is disposed in the accommodating groove of the external mold and spaced from one side wall of the accommodating groove. The internal mold has a base body and a blocking protrusion which is protruded from a bottom portion of a side surface of the base body facing to the side wall of the accommodating groove. A pressing block is accommodated in the accommodating groove of the external mold and clipped between the side surface of the internal mold and the side wall of the accommodating groove. The pressing block has a gap opened at a bottom portion of a side face thereof for pressing the blocking protrusion therein. A first fixing element is screwed into the first fixing hole of the external mold, with a distal end thereof resisting against the pressing block to further press the pressing block towards the internal mold so as to secure the internal mold and the pressing block in the accommodating groove. An ejecting pin is movably inserted in the internal mold with a top end thereof further projecting into the shaping cavity.

As described above, the female mold of the forging mold utilizes the fixing element and the pressing block to secure the internal mold in the accommodating groove of the external mold. When the internal mold is damaged, the external mold of the female mold can be repeatedly used by means of replacing the damaged internal mold with a new one in the accommodating groove of the external mold. So the cost of manufacturing the forging mold is greatly reduced.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
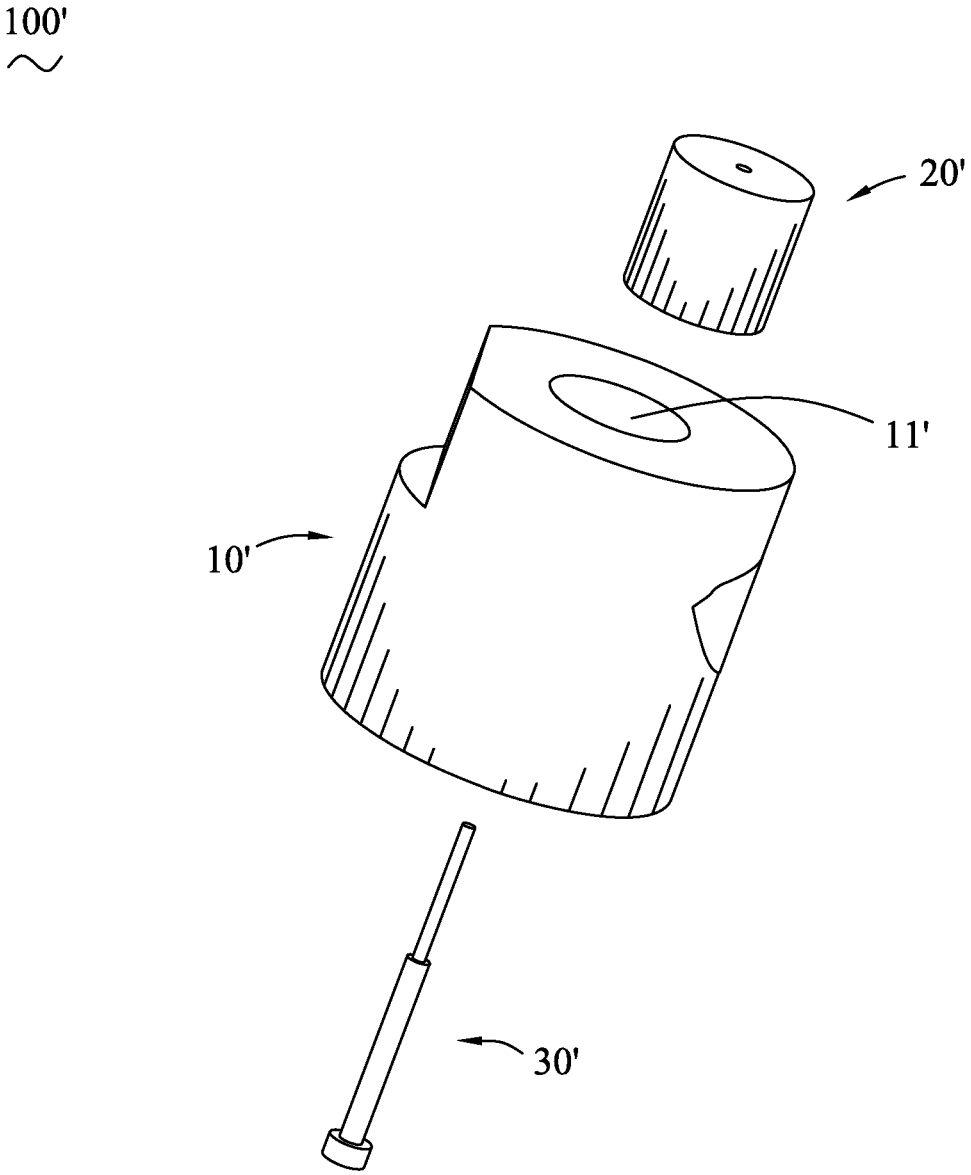
FIG. 1 (Prior Art)
FIG. 1 is an exploded perspective view illustrating a female mold of a forging mold according to the teaching of the prior art.
Figure 2:
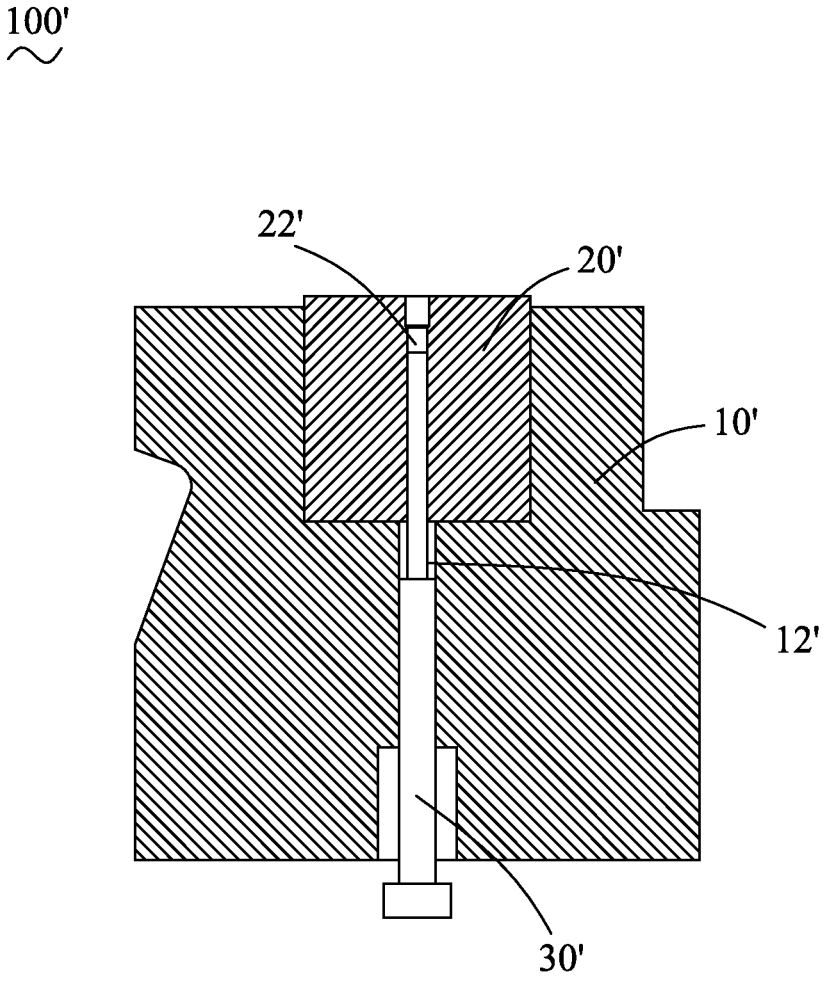
FIG. 2 (Prior Art)
FIG. 2 is a cross-sectional view illustrating the female mold of the forging mold of FIG. 1.
Figure 3:
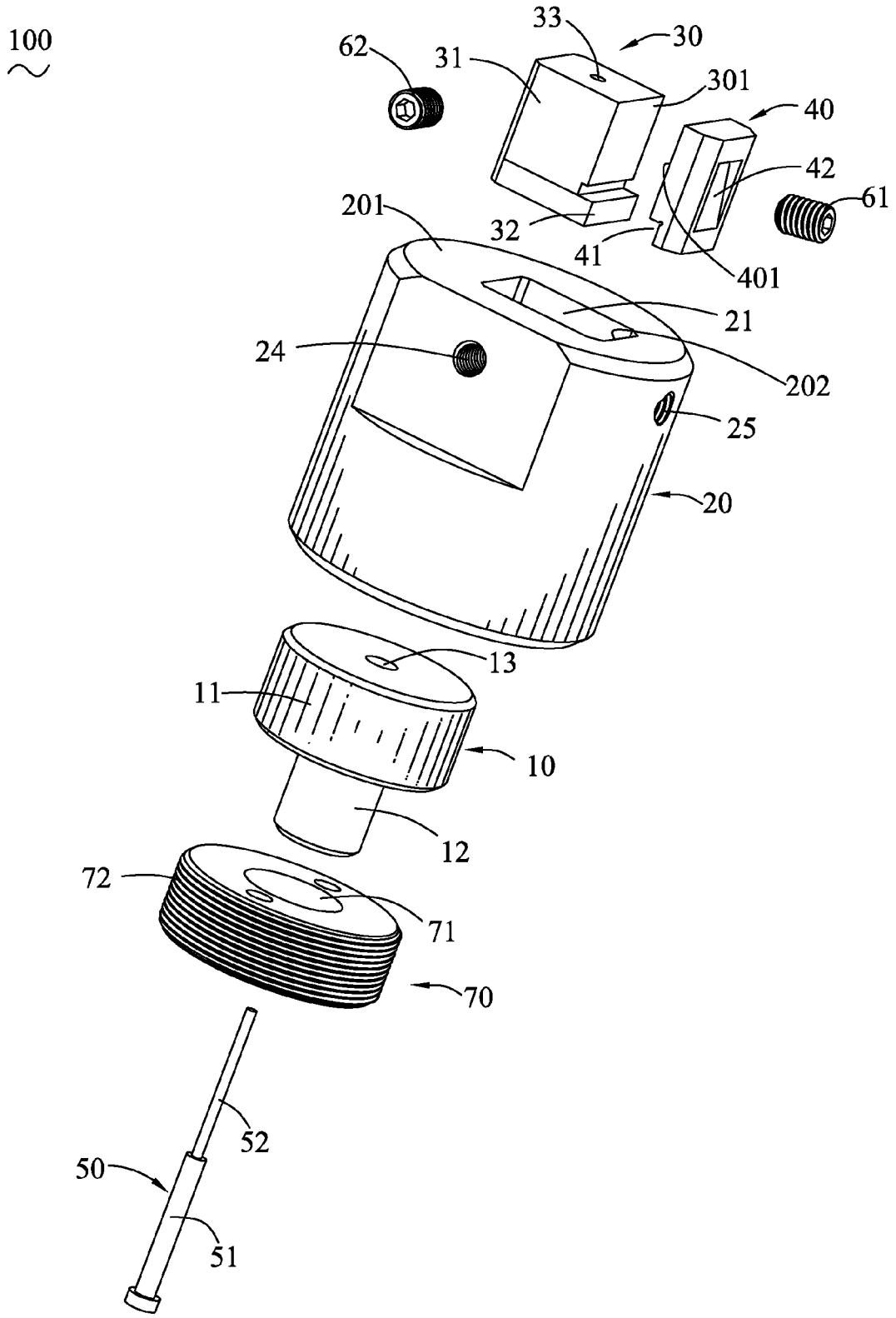
FIG. 3 is an exploded perspective view of a female mold of a forging mold in accordance with the present invention.
Figure 4:
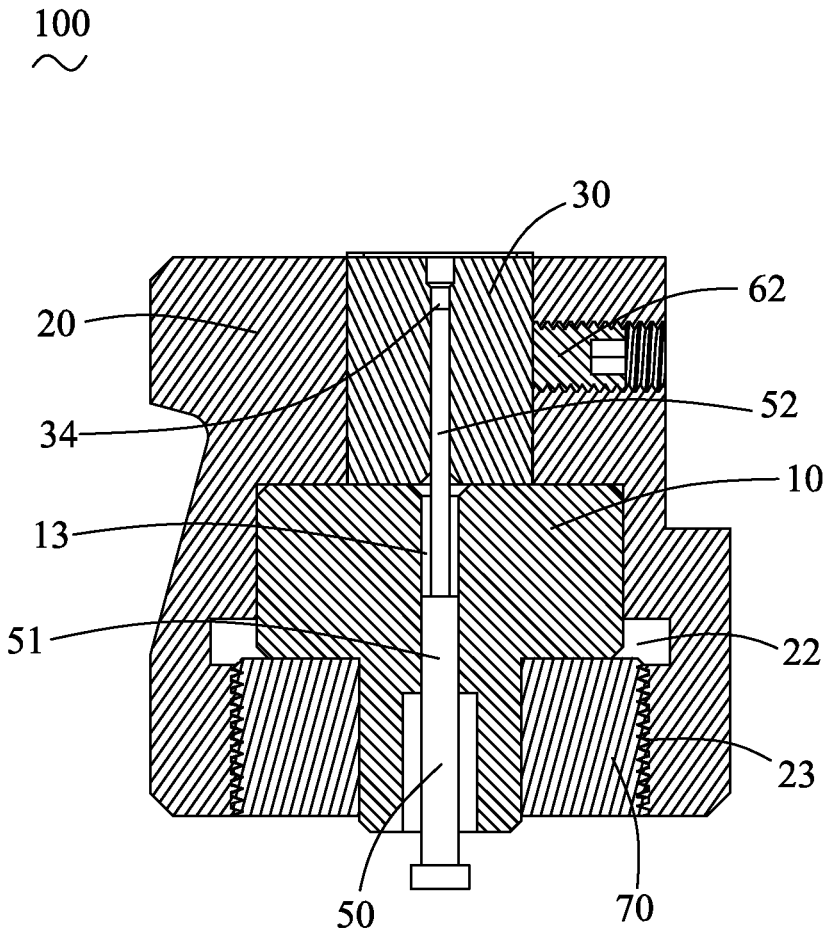
FIG. 4 is a cross-sectional view of the female mold of the forging mold of FIG. 3.

Referring to the drawings in greater detail, and first to FIG. 3 and FIG. 4, the embodiment of the invention is embodied in a forging mold which includes a female mold 100 and a male mold (not shown) coupling with the female mold 100 to defines a shaping cavity (not shown) therebetween. The female mold 100 includes a base 10, an external mold 20, an internal mold 30, a pressing block 40, an ejecting pin 50, a first fixing element 61, at least one second fixing element 62, and a fastening element 70. In this embodiment, both the first fixing element 61 and the second fixing element 62 are screws.

Refer to FIG. 3 and FIG. 4 again. The base 10 has a substantial cylindrical supporting platform 11 and an inserting pillar 12 extending downward from a substantial middle portion of a bottom of the supporting platform 11, with an axis of the supporting platform 11 coinciding with the one of the inserting pillar 12. The supporting platform 11 defines a passing hole 13 further penetrating through the inserting pillar 12.

Refer to FIG. 4. The external mold 20 defines a substantial rectangular accommodating groove 21 penetrating through a top surface 201 thereof, and a receiving groove 22 which is opened under the accommodating groove 21 and connected with the accommodating groove 21 with a bottom thereof opened freely. A lower portion of a periphery inside of the receiving groove 22 is provided with a female screw thread 23. A periphery outside of the external mold 20 defines a first fixing hole 25 extending towards the accommodating groove 21 to be connected with the accommodating groove 21. The periphery outside of the external mold 20 further defines at least one second fixing hole 24 extending towards the accommodating groove 21 and connected with the accommodating groove 21. The second fixing hole 24 extends levelly to be perpendicular to the accommodating groove 21.

Refer to FIG. 3. The internal mold 30 fastened in the accommodating groove 21 of the external mold 20 has a substantial rectangular base body 31 and a blocking protrusion 32 which is protruded from a bottom portion of a side surface 301 of the base body 31 to make the internal mold 30 show a substantial L-shape. A substantial middle portion of a top of the base body 31 defines a molding cavity 33. The base body 31 further defines an ejecting hole 34 extending vertically to penetrate through a bottom of the base body 31 and connected with the molding cavity 33. In this embodiment, the molding cavity 33 is of substantially cylindrical shape and an axis of the mold cavity 33 coincides with the one of the ejecting hole 34. Furthermore, the passing hole 13 of the base 10 has a diameter bigger than that of the ejecting hole 34 of the internal mold 30 seen from the cross-sectional view as shown in FIG. 4.

Refer to FIG. 3 again. The pressing block 40 which can be engaged with the internal mold 30 has a gap 41 opened at a bottom portion of a side face 401 thereof for pressing the blocking protrusion 32 therein. The pressing block 40 has a fixing groove 42 disposed at a side thereof opposite to the gap 41. The fixing groove 42 has an inner face thereof inclined outward from top to bottom, and the first fixing hole 25 slantwise extends along a direction perpendicular to the inner face of the fixing groove 42 to resist against the inner face.

The ejecting pin 50 has a base pole 51 and an ejector pole 52 having a smaller diameter than the one of the base pole 51. The fastening element 70 of substantial cylinder defines an inserting hole 71 vertically penetrating therethrough for receiving the inserting pillar 12 of the base 10 therein. A male screw thread 72 is provided on a periphery outside of the fastening element 70.

Refer to FIGS. 3-4 again. In assembly, the internal mold 30 is disposed in the accommodating groove 21 of the external mold 20 and space from one side wall 202 of the accommodating groove 21. The pressing block 40 is accommodated in the accommodating groove 21 of the external mold 20 and clipped between the side surface 301 of the internal mold 30 and the side wall 202 of the accommodating groove 21. The blocking protrusion 41 of the pressing block 40 is pressed in the gap 41 of the internal mold 30. The first fixing element 61 is screwed into the first fixing hole 25 of the external mold 20, with a distal end thereof resisting against the inner face of the pressing block 40 to further press the pressing block 40 towards the internal mold 30 so as to secure the internal mold 30 and the pressing block 40 in the accommodating groove 21. The second fixing element 62 is screwed into the second fixing hole 24 of the external mold 20 to resist against the internal mold 30 for further securing the internal mold 30 and the external mold 20 together. The base 10 is accommodated in the receiving groove 22 of the external mold 20 under the blocking action of the fastening element 70, wherein the inserting pillar 12 of the base 10 is inserted in the inserting hole 71 of the fastening element 70. The fastening element 70 is secured in a lower position of the receiving groove 22 by means of the male screw thread 72 of the fastening element 70 matching with the female screw thread 23 of the external mold 20. The fastening element 70 props up the supporting platform 11 to make the supporting platform 11 blocked under the internal mold 30. The ejector pole 52 of the ejecting pin 50 passes through the passing hole 13 to be inserted in the ejecting hole 34 with a top end thereof capable of further projecting into the molding cavity 33, and the base pole 51 is movably inserted in the passing hole 13.

As described above, the female mold 100 of the forging mold utilizes the fixing elements and the pressing block 40 to secure the internal mold 30 in the accommodating groove 21 of the external mold 20. When the internal mold 30 is damaged, the external mold 20 of the female mold 100 can be repeatedly used by means of replacing the damaged internal mold 30 with a new one in the accommodating groove 21 of the external mold 20. So the cost of manufacturing the forging mold is greatly reduced.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A forging mold including a female mold and a male mold coupling with the female mold to define a shaping cavity therebetween, the female mold comprising:

an external mold defining an accommodating groove penetrating through a top surface thereof, a periphery outside of the external mold defining a first fixing hole extending towards the accommodating groove to be connected with the accommodating groove;

an internal mold disposed in the accommodating groove of the external mold and spaced from one side wall of the accommodating groove, the internal mold having a base body and a blocking protrusion which is protruded from a bottom portion of a side surface of the base body facing to the side wall of the accommodating groove;

a pressing block accommodated in the accommodating groove of the external mold and clipped between the side surface of the internal mold and the side wall of the accommodating groove, the pressing block having a gap opened at a bottom portion of a side face thereof for pressing the blocking protrusion therein, and having a fixing groove disposed at a side thereof opposite to the gap, wherein the distal end of the first fixing element is buckled in the fixing groove, the fixing groove has an inner face thereof inclined outward from top to bottom, the first fixing hole extends along a direction perpendicular to the inner face of the fixing groove to resist against the inner face;

a first fixing element screwed into the first fixing hole of the external mold, with a distal end thereof resisting against the pressing block to further press the pressing block towards the internal mold so as to secure the internal mold and the pressing block in the accommodating groove; and an ejecting pin movably inserted in the internal mold with a top end thereof further projecting into the shaping cavity.

2. The forging mold as claimed in claim 1, wherein the periphery outside of the external mold defines at least one second fixing hole extending towards the accommodating groove to be connected with the accommodating groove, the female mold includes at least one second fixing element screwed into the second fixing hole of the external mold to resist against the internal mold for further securing the internal mold and the external mold together.

3. The forging mold as claimed in claim 2, wherein the second fixing hole extends levelly to be perpendicular to the accommodating groove.

4. The forging mold as claimed in claim 1, wherein the external mold further defines a receiving groove which is opened under the accommodating groove and connected with the accommodating groove with a bottom thereof opened freely, the female mold further includes a base and a fastening element, the base is accommodated in the receiving groove of the external mold under the blocking action of the fastening element and the fastening element is secured in a lower position of the receiving groove.

5. The forging mold as claimed in claim 4, wherein a lower portion of a periphery inside of the receiving groove is provided with a female screw thread, a male screw thread is provided on a periphery outside of the fastening element, the fastening element is secured in the lower position of the receiving groove by means of the male screw thread of the fastening element matching with the female screw thread of the external mold.

6. The forging mold as claimed in claim 4, wherein the base has a supporting platform and an inserting pillar extending downward from a substantial middle portion of a bottom of the supporting platform, the fastening element defines an inserting hole vertically penetrating therethrough, the inserting pillar is inserted in the inserting hole and the fastening element props up the supporting platform to make the supporting platform block under the internal mold, the ejector pin successively and movably passes through the inserting pillar, the supporting platform and the internal mold to project into the shaping cavity.

7. A forging mold including a female mold and a male mold coupling with the female mold to define a shaping cavity therebetween, the female mold comprising:

an external mold defining an accommodating groove penetrating through a top surface thereof, a periphery outside of the external mold defining a first fixing hole extending towards the accommodating groove to be connected with the accommodating groove, the external mold defining a receiving groove which is opened under the accommodating groove and connected with the accommodating groove with a bottom thereof opened freely, the female mold further including a base and a fastening element, wherein the base is accommodated in the receiving groove of the external mold under the blocking action of the fastening element and the fastening element is secured in a lower position of the receiving groove, a lower portion of a periphery inside of the receiving groove is provided with a female screw thread, a male screw thread is provided on a periphery outside of the fastening element, the fastening element is secured in the lower position of the receiving groove by means of the male screw thread of the fastening element matching with the female screw thread of the external mold;

an internal mold disposed in the accommodating groove of the external mold and spaced from one side wall of the accommodating groove, the internal mold having a base body and a blocking protrusion which is protruded from a bottom portion of a side surface of the base body facing to the side wall of the accommodating groove;

a pressing block accommodated in the accommodating groove of the external mold and clipped between the side surface of the internal mold and the side wall of the accommodating groove, the pressing block having a gap opened at a bottom portion of a side face thereof for pressing the blocking protrusion therein;

a first fixing element screwed into the first fixing hole of the external mold, with a distal end thereof resisting against the pressing block to further press the pressing block towards the internal mold so as to secure the internal mold and the pressing block in the accommodating groove; and an ejecting pin movably inserted in the internal mold with a top end thereof further projecting into the shaping cavity.

8. A forging mold including a female mold and a male mold coupling with the female mold to define a shaping cavity therebetween, the female mold comprising:

an external mold defining an accommodating groove penetrating through a top surface thereof, a periphery outside of the external mold defining a first fixing hole extending towards the accommodating groove to be connected with the accommodating groove;

an internal mold disposed in the accommodating groove of the external mold and spaced from one side wall of the accommodating groove, the internal mold having a base body and a blocking protrusion which is protruded from a bottom portion of a side surface of the base body facing to the side wall of the accommodating groove;

a pressing block accommodated in the accommodating groove of the external mold and clipped between the side surface of the internal mold and the side wall of the accommodating groove, the pressing block having a gap opened at a bottom portion of a side face thereof for pressing the blocking protrusion therein;

a first fixing element screwed into the first fixing hole of the external mold, with a distal end thereof resisting against the pressing block to further press the pressing block towards the internal mold so as to secure the internal mold and the pressing block in the accommodating groove; and an ejecting pin movably inserted in the internal mold with a top end thereof further projecting into the shaping cavity;

wherein the external mold defines a receiving groove which is opened under the accommodating groove and connected with the accommodating groove with a bottom thereof opened freely, the female mold further includes a base and a fastening element, the base is accommodated in the receiving groove of the external mold under the blocking action of the fastening element and the fastening element is secured in a lower position of the receiving groove, the base has a supporting platform and an inserting pillar extending downward from a substantial middle portion of a bottom of the supporting platform, the fastening element defines an inserting hole vertically penetrating therethrough, the inserting pillar is inserted in the inserting hole and the fastening element props up the supporting platform to make the supporting platform block under the internal mold, the ejector pin successively and movably passes through the inserting pillar, the supporting platform and the internal mold to project into the shaping cavity.

* * * * *